United States Patent [19]

McLaren et al.

[11] 4,389,802

[45] Jun. 28, 1983

[54] SCALLOPED PAPERBOARD INSERT FOR USE WITH PLASTIC LID

[75] Inventors: Edwin C. McLaren, Apple Valley; David J. Adamek, Minneapolis, both of Minn.

[73] Assignee: Champion International Corporation, Stamford, Conn.

[21] Appl. No.: 320,330

[22] Filed: Nov. 12, 1981

[51] Int. Cl.[3] ..... G09F 3/00; F24H 1/10; H05B 1/00

[52] U.S. Cl. ..... 40/307; 40/311; 220/306

[58] Field of Search ..... 40/307, 311, 315, 337, 40/20 A, 1.5, 1.6, 306; 215/23, 230; 220/306

[56] References Cited

U.S. PATENT DOCUMENTS

| | | | |
|---|---|---|---|
| 941,302 | 11/1909 | Borden | 220/23 |
| 1,209,998 | 12/1916 | Pinckert | 40/311 |
| 1,777,508 | 10/1930 | Tulip et al. | 40/307 |
| 1,872,159 | 8/1932 | McCreary | 40/307 |
| 2,174,618 | 10/1939 | Burdick | 220/23 |
| 2,184,039 | 12/1939 | Fenn et al. | 40/307 |
| 2,243,629 | 5/1941 | Hodgson | 40/307 |
| 2,304,912 | 12/1942 | Henchert | 40/307 |
| 2,305,361 | 12/1942 | Tanner | 220/23 |
| 2,882,624 | 4/1959 | Barothy | 40/337 |
| 3,070,275 | 12/1962 | Bostrom | 220/23 |
| 3,173,574 | 3/1965 | Goldsmith | 220/306 |
| 3,176,868 | 4/1965 | Crisci | 215/321 |
| 3,179,283 | 4/1965 | Amberg | 220/306 |
| 3,269,588 | 8/1966 | Ruekberg | 220/306 |
| 3,312,365 | 4/1967 | Balint | 40/307 |
| 3,421,653 | 1/1969 | Whaley | 215/230 |
| 3,777,336 | 12/1973 | Anderson | 40/315 |
| 3,782,575 | 1/1974 | Braun | 220/306 |
| 4,044,941 | 8/1977 | Knudsen | 229/43 |
| 4,111,322 | 9/1978 | Obrist et al. | 40/311 |

*Primary Examiner*—Robert A. Hafer
*Assistant Examiner*—Michael J. Foycik, Jr.
*Attorney, Agent, or Firm*—Evelyn M. Sommer; William W. Jones; John H. Mulholland

[57] ABSTRACT

A lid insert is provided for releasable connection to a plastic lid having a subtantially flat top surface and an upwardly and inwardly projecting peripheral bead disposed above and spaced from the top surface of the lid. The lid insert is made of paperboard material having a planar configuration generally corresponding to the configuration of the flat top surface of the lid. The periphery of the planar lid insert includes a plurality of alternating indents and nodes. The area defined by the outermost points of the insert is greater than the area defined by the upwardly and inwardly projecting bead. This peripheral configuration of alternating nodes and indents facilitates the initial placement of the insert on the lid and enables the insert to compensate for the different expansion characteristics of the lid and the lid insert.

1 Claim, 3 Drawing Figures

SCALLOPED PAPERBOARD INSERT FOR USE WITH PLASTIC LID

The subject invention relates to a new and improved paperboard lid insert for use with a plastic lid. More particularly, the subject invention relates to a paperboard lid insert which is adapted to be secured to a plastic lid of a container without glue, and which can tolerate substantial expansion and contraction without permanently deforming or disengaging from the lid.

DESCRIPTION OF THE PRIOR ART

Rigid wall containers or cartons with printed matter describing the contents thereof are well known. The printed matter may be disposed directly on the carton, or placed on a label which in turn is secured to the carton. Labels such as this have been glued to the carton, folded into engagement with walls of the carton, or placed in a receptacle on the carton.

U.S. Pat. Nos. 745,277, No. 1,870,974; No. 1,872,159 and No. 4,044,484 disclose inserts bearing printed matter that are built into or attached to the top portions of paperboard or metal containers. In all of these disclosures, slots or notches are disposed around the perimeter of the insert. The tabs formed between pairs of slits or notches are bent up or down and are wrapped or folded into engagement with a vertical side surface of the container.

Plastic containers have become widely used in recent years. However, it is difficult and costly to print indicia directly on the plastic. Thus, labels or inserts are virtually mandatory with plastic containers.

U.S. Pat. No. 3,421,653 discloses a combination wherein a label or insert is secured on a plastic lid without using glue. The lid shown in that patent is round and includes an upwardly and inwardly extending flange. The diameter of the insert is greater than the diameter of the circle formed by the innermost corner of the flange, but is less than the diameter of the depressed center panel of the lid. In arrangements of this type, the insert is secured to the lid by forcing or snapping the insert through the aperture formed by the inwardly and upwardly extending flange. The smaller diameter of the upper edge of this aperture tends to keep the insert in engagement with the lid in most circumstances.

The lid and insert combination described above has proved particularly useful for paper or paperboard inserts used with containers having circular plastic lids. However, the different coefficients of expansion of paper and plastic have caused problems with this combination. Specifically, changes in temperature of moisture content can make the insert expand. If this expansion is sufficiently great, the insert buckles; thereby obscuring part of the printed matter thereon, resulting in disengagement of the insert from the lid.

Various lid designs have attempted to deal with the problems caused by different expansion characteristics of paper and plastic. To facilitate comprehension of this prior art, consider a round lid wherein the diameter of the insert is D, the diameter of the circle defined by the upwardly and inwardly extending flange is $D_1$ and the diameter of the surface on which the insert sits is $D_2$. One approach has been to increase the differential between the diameter of the insert D and the diameter of the surface on which the insert rests ($D_2$), such that $D_2$ is substantially greater than D. By this approach the lid can be made to accommodate extreme expansion without having the insert buckle. However, this arrangement results in a sloppy fit, and can cause the insert to become disengaged from the lid under static temperature and moisture conditions. Another approach has been to increase the differential between the diameter of the insert D, and the diameter defined by the upwardly and inwardly projecting flange or bead $D_1$, such that $D_1$ is substantially less than D. Although this approach decreases the probability of disengagement, it makes the initial positioning of the lid insert considerably more difficult, and can cause damage to the lid insert during its initial positioning.

In view of the above it is an object of the present invention to provide a paperboard lid insert that can be secured to a lid without the use of glue or any other adhesive.

It is a further object of the present invention to provide a lid insert that will not be subject to potential damage or disengagement from the lid caused by the different expansion characteristics of the insert and the lid.

It is still a further object of the present invention to provide a lid insert that easily can be placed in a receptacle on the lid, and that will not be subject to significant movement once in position on the lid.

SUMMARY OF THE INVENTION

In accordance with this invention, a new and improved paperboard lid insert has been developed which can accommodate the different expansion characteristics of the paperboard and the plastic without risking disengagement of the insert from the lid. Briefly, this has been accomplished by disposing a number of indents about the perimeter of the insert. For example, the perimeter of the insert can assume a scalloped configuration. The resultant shape enables a significant part of the expansion caused by changes in temperature or moisture content to be concentrated into the indent areas of the insert, thereby minimizing variations in the outermost diameter. Furthermore, the nodes between indents function to absorb forces that may be exerted on the insert when expansion causes the insert to exceed the area of the surface it rests on. Thus, some or all of the nodes on the insert may buckle, but the central part of the insert will remain substantially flat and substantially in contact with the surface of the lid.

This design enables the paperboard insert to be secured to the lid without glue. As a result, the manufacturer can print the trade name and other basic product information on the top surface, and print coupons, recipes or the like on the bottom surface.

Further objects and advantages of the invention will become apparent from the reading of the following detailed description taken in conjunction with the drawings.

DETAILED DESCRIPTION OF THE INVENTION

Figure 1:
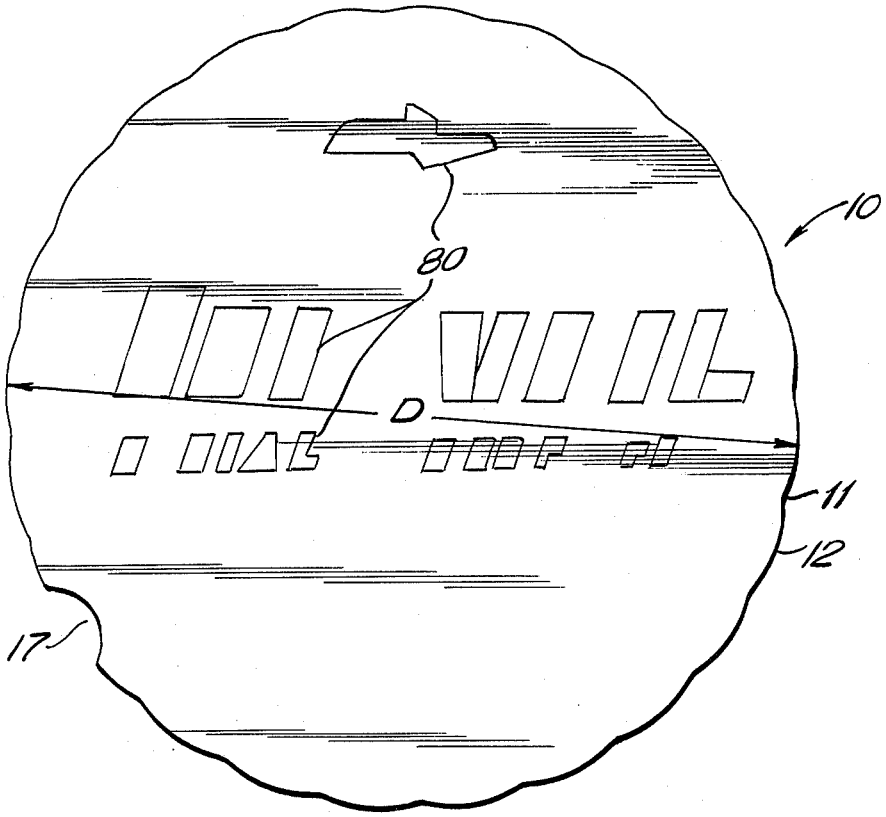
FIG. 1 is a plan view of the paperboard insert of the subject invention.

Referring to FIG. 1, the lid insert on the subject invention is designated by the number 10, and is preferably made of a paperboard material. In this embodiment, the lid insert is intended for use with a round plastic lid. Hence, the outermost points of lid insert 10 define a circle with diameter D. The perimeter of insert 10 includes a continuously connected series of alternating indents 11 and nodes 12 so as to define a generally scallop-shaped periphery. Each node 12 is generally arcuate, and extends convexly outward from the central portion of the insert. In this embodiment the indents 11 are defined by the intersecting arcuate surfaces of nodes 12. Other scalloped arrangements are equally acceptable; for example, the indents could be arcuate and disposed concavely about the perimeter of the insert.

In the preferred embodiment of the subject invention, nodes with one inch radii disposed about the perimeter of an insert with 2–11/16 inch radius have proved successful in enabling the insert to be placed on the lid and to remain on the lid through variations in temperature without having the insert lose its planar configuration. In that same embodiment, the difference between the innermost and outermost radii of the insert was approximately 1/16th inch.

Figure 2:
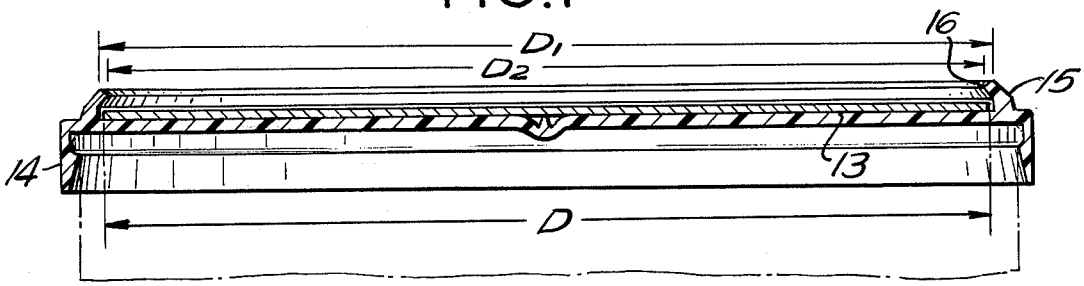
FIG. 2 is a cross sectional view of a plastic lid with the paperboard insert of the subject invention positioned thereon.

Referring now to FIG. 2, the insert 10 is dimensioned to fit flatly on the planar surface 13 of the plastic lid 14. The plastic of lid 14 does not expand or contract as much as the paperboard of insert 10 over changes in temperature or moisture content. Lid 14 includes an upwardly and inwardly extending bead 15. The circle defined by the inner edge 16 of bead 15 has a diameter $D_1$ which is less than diameter $D_2$ of planar surface 13. Furthermore, the diameter $D_1$ of the circle formed by edge 16 is smaller than the diameter D of the circle formed by the outermost points on the insert 10. Therefore, insert 10 has to be forced or snapped into engagement with planar surface 13 of lid 14.

The insert and lid combination is likely to be subjected to considerable temperature differentials. For example, in applications with dessert toppings the combination may be assembled in a warm environment, stored prior to sale in a freezer, stored after sale and in between uses in refrigerator, and used as a serving dish at room temperature. As a result of these different environments, there is a variation in ambient moisture content, and in some instances, pools or droplets of water may form. These changes in temperature and moisture characteristics will cause significant expansion or contraction of the paperboard insert, relative to the plastic lid. More specifically, in the cold dry environment, the paperboard insert will contract, and conversely in the warmer more humid environment the paperboard insert will expand. The plastic lid, on the other hand, will vary less with changes in temperature or moisture content.

The scalloped configuration of the perimeter facilitates the movement of an insert 10 with diameter D passed the opening with diameter $D_1$ provided by edge 16 of bead 15 even though D is greater than $D_1$. More specifically, each node 12 bends slightly to enable the insert 10 to be forced passed edge 16 of bead 15 without damaging or weakening the entire insert. This characteristic enables the use of an insert 10 with diameter D, which will be larger than the diameter $D_1$ defined by edge 16, through a wide range of temperature and moisture variations. In other words, an insert having diameter D greater than $D_1$ in a cold dry environment can readily be forced passed edge 16 in a warm or more humid environment where D is relatively large.

Figure 3:
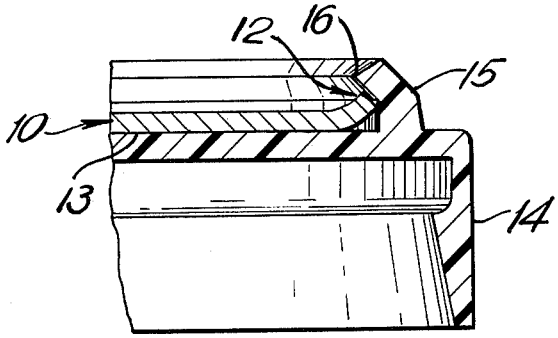
FIG. 3 is a partial cross sectional view of a lid with a node on the paperboard insert deformed as a result of expansion relative to the plastic lid.

Once insert 10 is in place on planar surface 13 of lid 14, a significant part of the expansion caused by changes in temperature or moisture will be concentrated in the indent area, thereby minimizing variations in the outermost diameter D. Furthermore, any expansion of insert 10 that causes the outer diameter D to exceed the diameter $D_2$ of planar surface 13 will merely cause deflections in nodes 12. This condition is shown in FIG. 3. The nodes 12 will most likely bend in the direction shown in FIG. 3 because they had been bent slightly in that direction when being forced into the lid. However, a deflection that is convex upward could be accommodated by each node. By localizing these deflections to nodes 12, the major part of paperboard insert 10 on which the printed matter is disposed would remain substantially flat, horizontal and in close proximity to planar surface 13. Furthermore, and most importantly, the problem of a major buckling of the insert 10 that would cause insert 10 to disengage from lid 14 has been substantially obviated.

Although diameter D is depicted as being less than diameter $D_2$ in FIG. 2, the insert diameter D could be equal to or slightly greater than $D_2$ through all temperature variations. Thus, nodes 12 of insert 10 would be bent up as shown in FIG. 3 during most or all temperature and moisture conditions to which the insert is exposed.

Referring to FIG. 1, a cutout 17 may be provided on the perimeter to facilitate the removal of the insert 10 from a plastic lid. Alternatively, paperboard insert 10 may be provided with a tab or similar device to facilitate removal of the paperboard insert. Removal of the insert 10 enables the manufacturer to display consumer information on both sides. Thus, the top could display indicia 80 to identify the product, while the bottom could include recipes, coupons or the like.

Accordingly, there is provided a new and improved lid insert that is capable of easy insertion onto a lid, and that is able to withstand substantial changes in temperature and ambient moisture content without buckling or disengaging from the lid.

The subject invention, and many of its intended advantages will be understood from the foregoing description, and it will be apparent that various changes may be made in the shape and construction of the lid insert, the nodes, or the indents, for example providing a rectangular insert having nodes and indents on its periphery, for use with a rectangular lid, and that these changes may be made without departing from the spirit and scope of the invention as defined by the following claims.

What is claimed is:

1. In combination, a plastic lid having an outer upper medial planar surface bounded by a circular upwardly and inwardly extending bead formed on said upper surface, said bead having a free inner edge defining a circle having a diameter $D_1$, said medial planar surface having a diameter $D_2$, which diameter $D_2$ is larger than the diameter $D_1$ said bead merging into a flat annular peripheral upper surface on said lid, said flat annular peripheral upper surface merging with an annular skirt portion depending downwardly from the periphery of said lid, said skirt portion including an upper and lower portion having a smooth contiguous outer surface and the inner surface of said upper skirt portion being recessed with respect to the inner surface of the lower portion of said skirt to define a shoulder therebetween and the inner surface of said lower skirt portion being flared outwardly at an acute angle with respect to the vertical; and a circular paperboard insert disposed on said medial planar surface of said lid, said insert being free of adhesive securement to said medial planar surface of said lid, said insert having an outer edge formed by a succession of contiguous curvilinear nodes and intervening indents, each node consisting of a portion of a circle having a predetermined radius which is smaller than the radius of said circular insert, said insert having a continuous central portion having printed matter disposed on at least one side thereof, the diameter D of said circular insert as defined collectively by the outermost points on said nodes being larger than the diameter $D_1$, and the diameter of said circular insert as defined collectively by said indents being of a size whereby deformation of said insert caused by expansion of said insert when the latter is disposed on said medial planar surface of said lid resulting from changes in ambient humidity, and caused by moving said insert past said bead is confined to said nodes.

* * * * *